United States Patent [19]

Yie

[11] Patent Number: 4,478,368

[45] Date of Patent: Oct. 23, 1984

[54] HIGH VELOCITY PARTICULATE CONTAINING FLUID JET APPARATUS AND PROCESS

[75] Inventor: Gene G. Yie, Auburn, Wash.

[73] Assignee: Fluidyne Corporation, Auburn, Wash.

[21] Appl. No.: 387,437

[22] Filed: Jun. 11, 1982

[51] Int. Cl.[3] ..... B05B 7/14; B24C 5/04

[52] U.S. Cl. ..... 239/430; 51/439; 239/600

[58] Field of Search ..... 239/429, 430, 431, 432, 239/596, 433, 600; 51/410, 439; 299/16, 29

[56] References Cited

U.S. PATENT DOCUMENTS

| | | | |
|---|---|---|---|
| 1,107,244 | 7/1911 | Carter | 51/439 |
| 2,447,123 | 8/1944 | Jones | 239/432 |
| 2,508,766 | 12/1946 | Morel | 51/439 |
| 3,424,386 | 2/1966 | Maasberg | 239/432 |

FOREIGN PATENT DOCUMENTS

| | | | |
|---|---|---|---|
| 192600 | 11/1907 | Fed. Rep. of Germany | 51/439 |
| 713473 | 10/1941 | Fed. Rep. of Germany | 239/429 |
| 1376591 | 12/1974 | United Kingdom | 239/596 |

*Primary Examiner*—John J. Love
*Assistant Examiner*—James R. Moon, Jr.
*Attorney, Agent, or Firm*—Thomas W. Speckman

[57] ABSTRACT

Apparatus and process for introducing solid particles into fluid streams under accurate control. Several embodiments of nozzle apparatus are disclosed utilizing a central fluid orifice or orifices and peripheral solids orifices for mixing the solids into the fluid stream. When multiple fluid orifices are utilized, an area of lower pressure is formed in the central portion of the combined fluid stream thereby aiding in the mixture of the solids into the fluid stream. A flow shaping nozzle is provided at the exit of the apparatus to increase the mixing of the solids within the fluid jets stream. The flow shaping nozzle may have both axial and radial freedom of movement for forming the fluid-solids stream and self-alignment, respectively. The apparatus and process of this invention, in one preferred embodiment, involves introduction of the solids in the form of a foam into the fluid jet stream. The apparatus and process of this invention is particularly well suited for abrasive uses of cutting hard materials such as reinforced concrete and steel, as well as utilization with a peripheral air shroud for underwater purposes.

23 Claims, 15 Drawing Figures

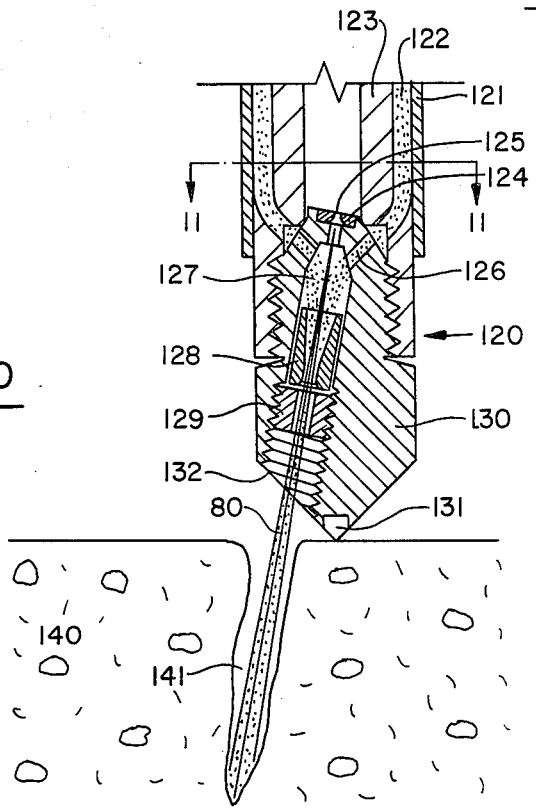
FIG. 10
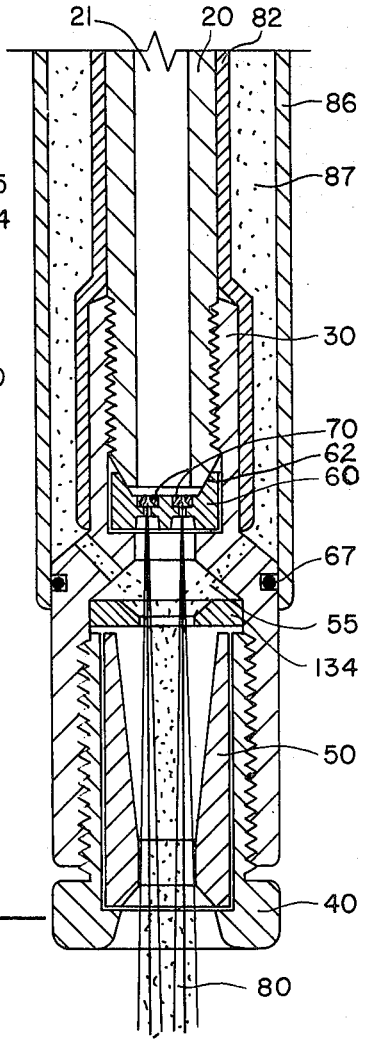
FIG. 9
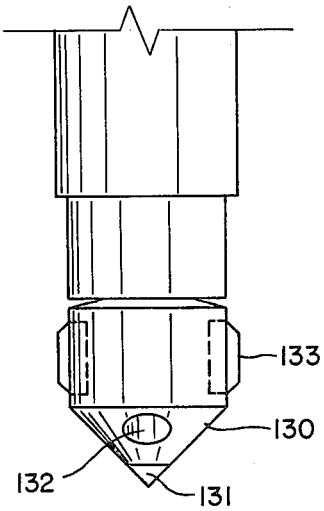
FIG. 12
FIG. 11A
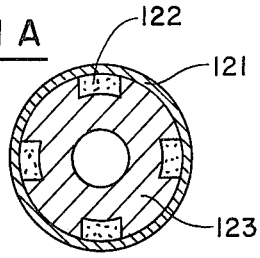
FIG. 11B
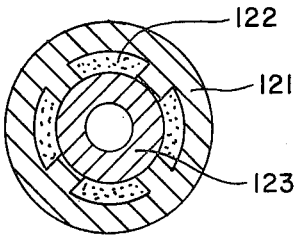

HIGH VELOCITY PARTICULATE CONTAINING FLUID JET APPARATUS AND PROCESS

BACKGROUND OF THE INVENTION

1. Field of the Invention

This invention relates to apparatus and process for introducing fine solid particles into fluid streams under accurate control. The solid particles are contained in a foam for mixture with a fluid jet stream. This invention can be advantageously used to generate abrasive fluid jet streams having material-cutting capabilities heretofore unobtainable.

2. Description of the Prior Art

Many materials encountered in industry are very hard and tough making cutting, drilling and shaping of these materials difficult with the requirements of special tools, techniques and skills. Tools and methods currently available for cutting these materials have shortcomings and limitations that need to be reduced or eliminated. Further, the present consideration of energy consumption and efficiency places new emphasis on improved tools and methods for cutting such materials.

The usual method for cutting steel plate involves the use of mechanical or thermal tools that have undesirable characteristics such as slow speed, tool wear, poor edge quality, alterations of metallurgical properties, and fire hazards.

Concrete, rock and minerals are also difficult to cut, drill or break because of their mineral compositions and abrasive nature. The presence of steel reinforcing rods in reinforced concrete further increases the difficulties. Currently, saws and drills equipped with carbide or diamond-studded cutting edges are the only workable tools for cutting or drilling these materials. These tools have recognized limitations, such as rapid wear of cutting edges; ability to cut only shapes and patterns allowed by the geometry of the cutting edges; expense of diamond-studded edges; necessity to maintain a large tool inventory to meet the requirements of various jobs; slow operation due to hardness and abrasiveness of material to be cut; and the cutting can be very noisy, dusty and fatiguing to operating personnel. Breaking concrete and rock is usually achieved by use of the commonly available jackhammers which are grossly inadequate. Thus, removing a large volume of concrete or rock without using explosives can be a slow, expensive and energy consuming operation.

There are also difficulties associated with cutting high strength plastics and composites in production plants. For example, graphite and Kevlar fiber reinforced laminates are difficult to cut because of the abrasive nature of these fibers and the need to avoid delamination in cutting. In some operations, the work pieces are three dimensional wherein cutting or trimming must follow the surface contours and the work pieces must be rigid enough and/or fastened to withstand the cutting forces. The development of new engineering materials has imposed new requirements for cutting tools and techniques. The need for new and more effective cutting methods has become very urgent and continuous efforts have been devoted in recent years to the development of better cutting methods.

One of the relatively new methods for cutting and breaking materials utilizes a stream of water traveling at high velocity in a water jet. The water jet is already being employed to cut a wide variety of materials, including synthetic polymers, leather, paper products, fiberglass, asbestos and textiles. Description of the water jet apparatus and its applications are found in the following publications: H. D. Harris and W. H. Brierley, "Application of Water Jet Cutting", Paper G-1, 1st International Symposium on Jet Cutting Technology, Coventry, U.K., April 1972; E N. Leslie, "Application of the Water Jet to Automated Cutting in the Shoe Industry", Paper F-3, 3rd International Symposium on Jet Cutting Technology, Chicago, May 1976; and T. J. Labus, "Cutting and Drilling of Composites Using High Pressure Water Jets", Paper G-2, 4th International Symposium on Jet Cutting Technology, Canterbury, U.K., April 1978. In the apparatus and methods described, water is pressurized to a level as high as 60,000 psi and ejected through a small orifice to generate a high velocity, substantially coherent water jet. Such a water jet possesses high kinetic energy and can cleanly cut many materials. There are many advantages for using a water jet to cut materials, including absence of tool wear, absence of direct tool contact with the target material, and minimum dust problems. In some applications, the speed of cutting is also increased and the quality of cut improved by employing the water jet method.

The water jet cutting method has not been used widely due primarily to its high equipment cost resulting from the high fluid pressure involved, high energy consumption and the inability to satisfactorily cut hard and tough materials, such as concrete, rock, glass, hard plastics and metals. Attempts have been made to cut such materials with a water jet by increasing the water pressure and thus the power input to a very high level. These attempts have not been satisfactory due to the cost of the equipment escalating drastically with the increased pressure and power while the quality of cutting has not been improved proportionally. For example, attempts to cut concrete with a water jet having power input in excess of 200 hp and water pressure greater than 50,000 psi have not been a complete success as concrete and aggregates tend to spall rather than being cut cleanly and the debris generated by the high pressure water jet settles in the cut volume hampering the cutting process. The application of high pressure water jets to cut rock and concrete has been discussed in many publications including: L. H. McCurrich and R. D. Browne, "Application of Water Jet Cutting Technology to Cement Grouts and Concrete". Paper G-7, 1st International Symposium on Jet Cutting Technology, Coventry, U.K., April 1972; A. G. Norsworthy, U. H. Mohaupt and D. J. Burns, "Concrete Slotting with Continuous Water Jets at Pressures up to 483 MPa", Paper G-3, 2nd International Symposium on Jet Cutting Technology, Cambridge, U.K., April 1974; and T. J. Labus and J. A. Hilaris, "Highway Maintenance Application of Jet Cutting Technology", Paper G-1, 4th International Symposium on Jet Cutting Technology, Canterbury, U.K., April, 1978. A high pressure pulsed water jet apparatus and process is taught by U.S. Pat. No. 4,074,858.

Abrasive particles propelled by compressed air have been used to cut many hard materials. This method can be quite effective when the abrasive particles are accelerated to high velocity and ejected through a suitable nozzle. However, the difficulty in containing the particles and dust during cutting operation prohibits its use in large scale material cutting. Currently, air-propelled abrasive powders are used for deburring metals and for surface preparation of materials where a hood or an enclosure can be employed to contain the dust. A wide variety of abrasive powders, such as silicon carbide, aluminum oxide, garnet, glass beads and silica sand are used for such applications.

The combination of solid particles with a fluid jet has been employed for several uses. For example, U.S. Pat. No. 2,821,396 teaches solid particles in an air or steam injector as an attrition impact pulverizer; U.S. Pat. No. 3,424,386 teaches mixing of granular solids with a liquid for use in sandblasting; U.S. Pat. Nos. 3,972,150 and 3,994,097 teach water jets of particulate abrasive for cleaning with water pressures under 5,000 psi; U.S. Pat. No. 4,080,762 teaches a fluid-abrasive jet for paint removal with fluid pressures up to 30,000 psi; and U.S. Pat. No. 4,125,969 teaches a wet abrasion blast cleaning apparatus and method utilizing soluble abrasive materials. These patents show that combining abrasive particles with water jets have not produced an abrasive water jet capable of cutting hard materials. The jets generated by the devices taught by these patents can at best clean and blast the surface of hard materials. The prior devices fail in achieving cutting capability of hard materials primarily because the devices fail to generate a sufficiently high velocity and sufficiently coherent water jet; and fail to mix the abrasive particles with the high velocity water stream in sufficient quantity.

U.S. Pat. Nos. 3,424,386, 3,972,150, 4,080,762 and 4,125,969 all teach the abrasive (sand) stream to be in the central portion of the nozzle while the pressurized fluid is introduced into the peripheral area surrounding the central sand stream. A ring orifice plate or disk such as employed in U.S. Pat. Nos. 3,424,386, 4 080,762 and 4,125,969 to provide the fluid jets around the sand stream has many disadvantages including: the introduction of pressurized fluid tangentially into a nozzle a short distance above the orifice disk is not conducive to the generation of a coherent fluid jet due to flow disturbances upstream of the orifices; sand in the central portion of a nozzle creates an abrasive environment that can weaken the interior wall of the annular fluid chamber without being detected; pressurized fluid in the outer annular space results in a nozzle that is very large in dimensions as both interior and exterior walls must be sized to accommodate the fluid pressure; and sealing the annular orifice disk can be very troublesome. The U.S. Pat. No. 3,994,097 teaches a centrally located water jet while sand is fed into a nozzle chamber through a single sand passageway. The sand is forced into the water jet by passage through a conical nozzle. This patent recognizes abrasion problems within the nozzle and the necessity of exact alignment. These problems would be intensified at higher pressures. All of these patents teach mixing abrasive into water by (1) intercepting an abrasive stream with water jets, and (2) forcing abrasives, water and air through a conical nozzle, without concern of fluid actions.

The prior art devices have generally utilized compressed air to deliver the abrasive particles to a nozzle in which the particles are mixed with the water stream. It is desirable, however, for the particles to be wetted by water before they are to be most effectively mixed with the water. Further, if the water stream is coherent and is traveling at high speed, the conditions are not favorable for the air propelled particles to be mixed into the water stream. At best, some particles are carried away by the water droplets formed around the coherent core of the water stream. The introduction of abrasive particles would be significantly improved if the water jet is made to disperse into droplet form, however, the resultant abrasive water jet would be weak and incapable of cutting hard materials.

The transporting of abrasive particles by compressed air or gas also has other undesirable characteristics. Since abrasive particles are generally heavy, the air flow must be sufficiently turbulent to move the particles, otherwise the particles will settle and block the passage. The air or gas must be dry to avoid agglomeration of particles and resulting blockage of the passage. Further, erosion of tubings, hoses and fittings by the abrasive particles is a common problem. The air or gas used to propel the abrasive particles can interfere with the formation of a coherent abrasive water jet and result in a dust problem as some abrasive particles will escape with the air or gas without being mixed with the water.

A possible alternative approach of transporting abrasive particles to the nozzle is to convert the abrasives to a slurry as taught by U.S. Pat. No. 3,972,150. This abrasive slurry is then pumped into a nozzle and mixed with the water jet. One problem of this approach is that the slurry must be mixed into the water jet, the mixing of which can consume a significant amount of the water jet's kinetic energy as the slurry rather than the individual abrasive particles must be accelerated to the water jet velocity. Such loss of water jet energy can be particularly severe if the abrasive slurry is viscous. These problems are increased by the fact that high viscosity may be necessary in formulating such an abrasive slurry, if settlement of the particles is to be avoided.

SUMMARY OF THE INVENTION

This invention provides a process suited for introducing heavy abrasive particles into high velocity fluid jets, such as water jets, without the above problems. This invention provides apparatus to generate fluid jets, such as water jets, having unique material cutting capabilities. This invention also provides a process which is applicable to introduce fine solid particles, abrasive or otherwise, into a fluid jet, which could be liquid or gas.

The particulate-fluid mixing devices of this invention provide pressurized fluid flow through the central portion of a nozzle and particulate introduction peripherally. Thus, the fluid flow is not disturbed and the peripheral portion of the nozzle may be readily adapted to accommodate a wide variety of particulate requirements, such as volume. The devices of this invention provide improved fluid jet quality and preferably utilize multiple fluid jets and flow shaping construction to provide a conical volume of reduced pressure in the central portion of the fluid jet to readily entrain and accelerate the particulates in the fluid jet stream. A coherent, well mixed particulate-fluid jet is provided by the apparatus and process of this invention.

One important feature of the process and apparatus of this invention is to provide the solid particles contained in a foam for mixture with a fluid jet stream. As the foam containing the solid particles contacts the fluid stream, the gaseous bubbles dispersed throughout the foam will collapse and the solid particles dispersed in the bubble film throughout the foam will be carried away by the fluid stream. The foam containing the solid particles provides a particle of wetted surface to the fluid stream and presents little interference to the fluid stream as the foam is largely gaseous bubbles in a much lesser amount of liquid than experienced with prior particulate containing slurries. Therefore, the energy loss of the fluid jet in principally accelerating the solid particulates is much less than the prior art devices wherein slurries of particulates were introduced. The transport of the solid particulates in foam is advantageous since the foam containing solids can be readily released under pressure or pumped through tubing over a long distance without settling of the solids and with reduced wear or abrasion problems when the solids are abrasive particulates. The transport of solid particles by foam in accordance with this invention also provides much better control over introduction of solid particulates into the fluid stream since more precise control over the pumping range or regulation of rate of release of pressurized foam may be readily achieved. In accordance with the introduction of abrasive solid particulates to a fluid stream according to this invention, high amounts of abrasive particles may be introduced into the fluid jet stream and the resultant particulate containing jet stream has cutting capabilities not previously attainable. Further, the manner of introduction of solid particles into the fluid stream by a foam avoids dust and reduces consumption of solid particulates. The properties of the foam used for wetting, carrying and introduction of solid particulates into the fluid stream can be readily adjusted to meet special needs by varying formulations, such as to obtain control of bubble size, solids content, rheological properties, freezing temperatures, abrasion capabilities, and the like.

Apparatus to generate solid particulate entrained fluid jets suitable for cutting hard materials, such as plastics, glass, ceramics, metals, concrete and rock are specifically disclosed in the following description. The same apparatus may be used for lower pressure particulate entrained fluid jets for use in surface alteration or cleaning, fuel introduction into combustion chambers and other uses which will be apparent. For such low pressure uses it may not always be advantageous to introduce the solids in a foam.

BRIEF DESCRIPTION OF THE DRAWING

Specific embodiments of apparatus suitable for use in this invention are shown in the drawing wherein:

FIG. 9 is a cross-sectional view showing another embodiment of a particulate-fluid jet nozzle according to this invention with a different orifice cone;

FIG. 10 is a cross-sectional view showing another particulate-fluid jet nozzle according to this invention used in conjunction with a drill;

FIGS. 11A and 11B are sectional views of different embodiments along the line 11—11 shown in FIG. 10;

FIG. 12 is a side view of the apparatus shown in FIG. 10;

DESCRIPTION OF PREFERRED EMBODIMENTS

Figure 1:
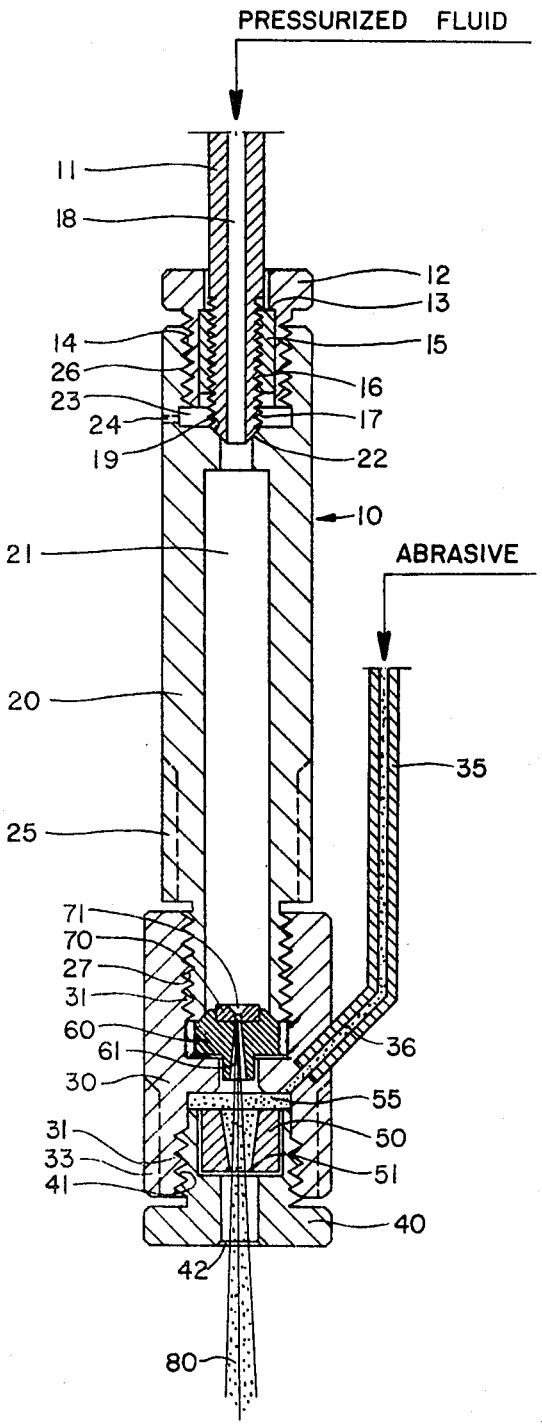
FIG. 1 is a cross-sectional view of a particulate-fluid jet nozzle assembly according to one embodiment of this invention.

Generally the process of this invention involves producing a fluid jet stream comprising solid particulates by forming at least one fluid jet stream, introducing solid particulates through multiple orifices at an angle to and peripheral to the fluid jet stream, mixing the solid particulates with the fluid jet stream, and passing the mixed solid particulate-fluid jet stream through a converging flow shaping nozzle. The throat of the flow shaping nozzle confines the output of the mixed solid particulate-fluid jet stream.

One embodiment of this invention involves producing a fluid jet stream comprising solid particulates by introducing the solid particules into the fluid stream in a foam carrying the solid particulates. The foam carrying solid particulates may be prepared and stored away from the apparatus for forming the fluid jet and for introducing the particulate solids into the fluid stream.

A wide range of solid particles may be used in the process of this invention, most suitably those having average diameters from about 2 microns to about 0.05 inches, preferably particles from about 10 microns to about 200 microns. Further, due to the maintenance of the solid particulates in a foam, particles having high densities may be used according to this invention. Especially suitable solids for use in this invention include abrasives such as silicon carbide, aluminum oxide, garnet, silica sand, metallic slag, glass beads, and the like. The process and apparatus of this invention may be used for mixing solid particulates with a fluid stream of liquid or gas for any desired purpose. For example, the solid particles may be ground coal and the fluid may be natural gas or fuel oil, and the nozzle used to generate a jet of the solid-fluid mixture for combustion purposes.

The solid particulates may be introduced in dry condition through multiple orifices into a fluid jet stream, but are preferably introduced in the form of a foam. To form the foam the solid particulates are first mixed with the desired liquid to form a slurry. A wide variety of organic or inorganic liquids may be used, such as water, ethylene glycol, diethylene glycol, and other liquids for special purposes to form the slurry. The solid particulates may be accurately measured into a pre-measured amount of liquid to form a slurry by mixing. The solid particulates may be wetted prior to forming the slurry by first mixing the solid particles with the slurry liquid or other wetting liquid to obtain desired properties. Such wetting may be enhanced by mixing a wetting and/or dispersing agent with the solid particles or the wetting and/or dispersing agent may be added to the wetting and/or slurry liquid. For example, some solids may not be wetted well by water which is the desired slurry liquid in a particular case. In such case, the solids can be wetted first with a small amount of oil or other liquid that is known to wet the solids well and subsequently, surfactant that is compatible with the wetting liquid and with water may be added to the wetted solids. The selected wetting liquid may not be miscible with water, but the addition of a selected surfactant enables each wetted solid particle to be coated with the surfactant molecules and the coated particles can then be suspended in water to form a slurry.

Suitable surfactants are well known in the art to be useful as wetting and/or dispersing agents in a wide variety of systems. Specific surfactants offer certain desired properties and advantages with certain liquid-gas or liquid-liquid or liquid-solid interfaces. The selection of a surfactant is determined by the solid particles involved, the liquid used in making the slurry, the gas used in generating the foam, and the desired amount of foam and foam stability. For example, suitable surfactants include sodium stearate, potassium stearate, stearic acids, sulfonic acids, alkyl sulfates, alkylolamides, alkyl sulfoacetates, alkyl aryl polyetheralcohols, and the like. Surfactants which are non-ionic, anionic or cationic may be used depending upon the materials used and desired properties, such as polyethylene oxides, sodium lauryl sulfates, and cetyl pyridinium chlorides, respectively. Settlement of the solid particulates in the slurry, especially high density materials, can be avoided by adding a thickening agent. Especially suitable thickening agents are thixotropic agents. Suitable thickeners or thixotropic agents are well known in the art and common materials include sodium silicate, carboxy methyl cellulose, hydroxy ethyl cellulose, sodium carboxy methyl cellulose, polyethylene oxide, attapulgite clay, sepiolite clay, sodium bentonite, polyacrylamides, natural or modified polyssacharides such as guar gum, xanthum gum bipolymer and starch based polymers. Some of the chemicals referred to as thickening or thixotropic agents also act as foam stabilizers to prevent collapse of the foam bubbles sooner than desired and some also act as lubricating agents.

In the practice of this invention, it is suitable for the slurry to comprise about 100 to about 800 grams/liter of solids, preferably about 300 to about 500 grams/liter.

The slurry comprising solid particulates is then formed into a foam by any suitable method. In one embodiment, the slurry comprising solid particulates and at least one surfactant acting as a foaming agent may be placed in a pressure vessel with a propellent. Release of the mixture from the pressure vessel instantly generates the desired foam which may then be readily transported. Various propellents are well known to the art and suitable for use in the process of this invention, such as air, carbon dioxide, propane, butane, and fluorinated hydrocarbons. Another means of forming a suitable foam is by mixing a stream of the slurry containing a foaming agent with a stream of gas, such as air, to generate a foam. This method is widely used in various spraying processes. In both of the above described methods for forming the foam, the foam is generated as a result of the action of the foaming agent or surfactant with the gas.

In another embodiment of forming foam according to the process of this invention, an in situ blowing agent may be added to the slurry and activated as desired. The activation of the blowing agent is usually accomplished by heat or by a catalyst. The bubbles produced by such blowing agents include nitrogen, carbon dioxide or other gases, depending upon the blowing agent used. Blowing agents are well known such as sodium bicarbonate and many blowing agents used in the manufacture of foam rubber and plastics including p-toluene sulfonyl hydrazide, marketed by Uniroyal, Inc. under the term Celogen TSH and azoalkenes, such as those marketed by Penwalt Corporation under the name Lucel. The amount of gas produced by each type of blowing agent is precisely known and thus the bubble size generated can be well controlled.

In one preferred embodiment of the process of this invention, abrasive water jets are formed which are capable of cutting hard and aggregate containing materials. In such cases, commonly used abrasives, such as silicon carbide, aluminum oxide, garnet and fine sand are all readily wetted with water and a wide variety of surfactants suitable for forming thixotropic slurries and for use as foaming agents are well known for water based systems. Such an aqueous abrasive slurry can be stored, easily handled and easily transported. Propellents can be added to the slurry which will provide instant generation of aqueous abrasive foam by either being stored in pressurized vessels or by pressurizing the vessel at time of use with compressed air. Releasing of the pressure results in the foam. In another embodiment, the aqueous abrasive slurry can be pumped to the fluid jet apparatus as a slurry and mixed with a gas stream to generate the foam just prior to mixing with the fluid jet. In either case, the abrasive solid particulates are in the form of a stable slurry or a stable foam, the particles being homogeneous throughout the system and greatly reducing erosion problems as compared with prior systems which used gaseous streams to transport the solids.

An important aspect of this invention is the provision of nozzles suitable for proper mixing of solid particulates with fluid jet streams and particularly mixing foam containing abrasives with a high pressure fluid jet stream to form and maintain the desired shape high velocity particulate containing fluid jet stream. The nozzles disclosed herein also can be advantageously used in the formation of high velocity particulate containing fluid jet streams utilizing dry particulate materials, such as abrasives. While the apparatus described herein is primarily apparatus for cutting hard and aggregate containing materials, the process of this invention for producing a fluid jet stream comprising solid particulates by introducing the solid particulates contained in a foam into a fluid jet stream is useful for various lower pressure jet streams for surface cleaning and treating uses as well.

Figure 2:
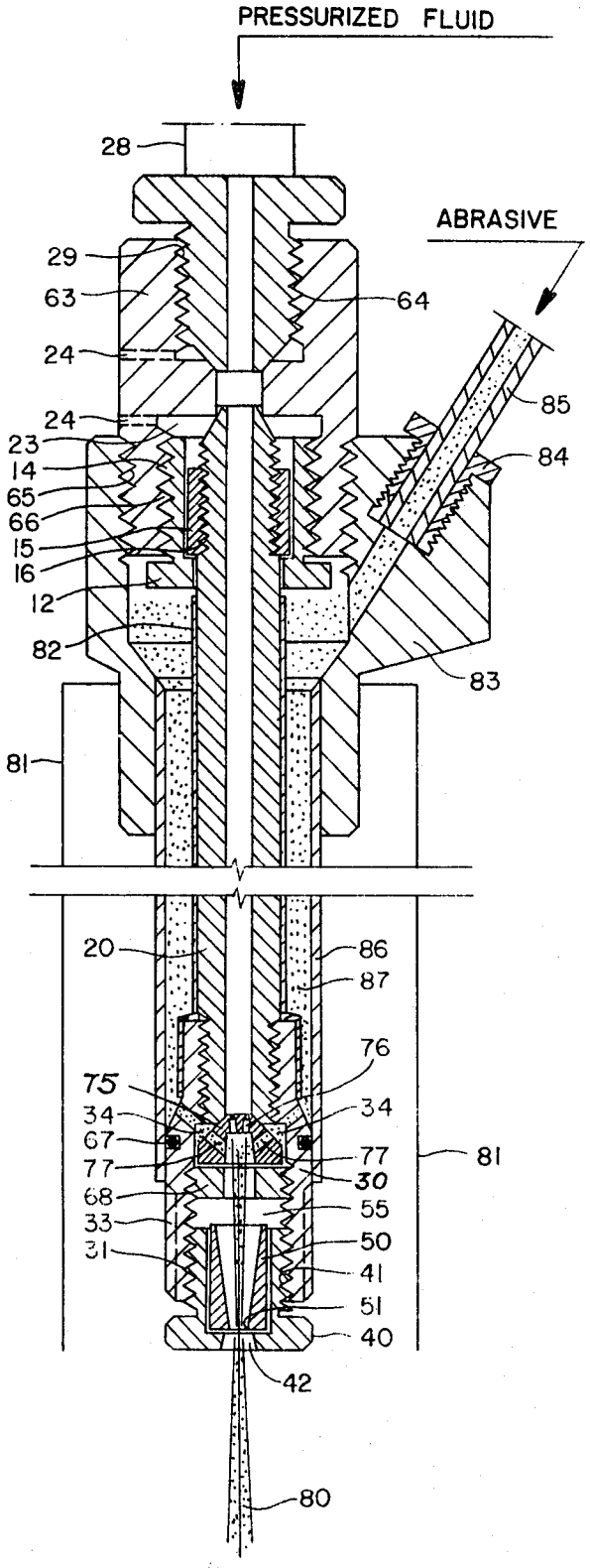
FIG. 2 is a cross-sectional view showing another particulate-fluid jet nozzle of this invention with an integrated orifice cone.

In one embodiment, the apparatus of this invention is a fluid-solid mixing nozzle generally shown in FIG. 1 as 10 comprising nozzle body 20 defining pressurized fluid chamber 21 and capable of withstanding internal fluid pressures used; an orifice support cone 60 and orifice plate 70 as shown in FIG. 1, or an orifice cone 75 as shown in FIG. 2; a flow shaping cone 50 for facilitating the combination of the solids in the fluid stream and shaping the fluid stream; pressurized fluid inlet means 11; solids feed means 35; and a nozzle assembly means 40 permitting disassembly of the support cone or orifice cone and flow shaping cone for cleaning and/or replacement.

Referring specifically to FIG. 1, nozzle body 20 forms pressurized fluid chamber 21 capable of maintaining desired high fluid pressures. The pressurized fluid is introduced into pressurized fluid chamber 21 through pressurized fluid inlet tube 11 forming inlet tube through passage 18 and maintained in communication with pressurized fluid chamber 21 by being threadedly engaged with collar 15 which is held in position by gland nut 12 which is threadedly engaged to nozzle body 20. Pressure release chamber 23 is provided with pressure relief conduit 24 to the atmosphere. Upon reading this disclosure it is apparent that any pressurized fluid inlet means which provides pressurized fluid to pressurized fluid chamber 21 is suitable.

As shown in FIG. 1, pressurized fluid chamber 21 is larger in cross section than inlet tube through passage 18 which reduces the fluid velocity through chamber 21. It is also preferred that the walls of fluid chamber 21 have smooth surfaces to minimize fluid turbulence. Orifice plate 70 having orifice 71 shaped for generating a substantially coherent fluid jet is mounted on top of support cone 60. Orifice plate 70 is preferably made from a hard material, such as hardened steel, hard ceramics, tungsten carbide, diamond, ruby or sapphire. Orifices of such materials have a long lifetime, withstand high fluid pressures, and can be made by methods known to the art to very high precision standards. Materials such as hardened steel and tungsten carbide are suitable for lower pressures and less critical applications. Support cone 60 has through passage 61 aligned with orifice 71. Support cone 60 is held tightly against nozzle body 20 by nozzle cap 30 being threadedly engaged with the lower portion of nozzle body 20. A tapered fit between support cone 60 and nozzle body 20 centers support cone 60. Wrench flats 25 and 33 permit tightening of nozzle cap 30 upon nozzle body 20. Nozzle nut 40 with through passage 42 is threadedly engaged with the lower end of nozzle cap 30 and holds loosely fitting flow shaping cone 50. In the embodiment shown in FIG. 1, abrasive feed means 35 with abrasive feed passage 36 provides abrasive to mixing chamber 55 above flow shaping cone 50. Flow shaping cone 50 has through passage 51 which is a tapered bore in which the solid particles are mixed with the fluid jet. The exit of through passage 51 is sized according to the diameter of the fluid jet at that location, the threaded nozzle nut 40 allowing some adjustment to the size relationship between the fluid jet and the cross-sectional area of flow shaping cone 50. Having the loose fit, flow shaping cone 50 will align itself with the fluid jet so that it is properly centered. The high velocity particulate containing fluid jet 80 leaves the apparatus through nozzle nut through passage 42.

FIG. 2 shows another embodiment of an apparatus of this invention using an orifice cone for mixing of the solid particulates with the fluid stream. The high velocity particulate containing fluid jet apparatus shown in FIG. 2 shows orifice cone 75 with multiple fluid orifices 76 which may generate substantially parallel jets or converging fluid jets which are particularly advantageous for mixing with foam containing particulates introduced by multiple abrasive orifices 77. Various embodiments of orifice cone 75 are further disclosed in FIGS. 3–7 and the more detailed description to follow. As shown in FIG. 2, the abrasive enters through abrasive supply hose 85 into abrasive chamber 87 an annular cavity surrounding nozzle body 20 and defined by outer tube 86. Protective sleeve 82 is shown surrounding nozzle body 20 to avoid erosion of the nozzle body by the abrasive particles. Cross linked polyethylene or other suitable materials may be used for such a protective sleeve as well as for abrasive supply hose 85. Abrasive chamber 87 may be sealed at its lower end by O-ring seal 67. In the embodiment shown in FIG. 2, mounting block 83 and tube hose transition member 63 are engaged with nozzle body 20 by gland nut 12 and collar 15. Hose fitting 28 is provided for pressurized fluid input. Orifice cone 75 is tightly engaged against the end of nozzle body 20 by orifice cone retaining nut 68 threadedly engaged with nozzle cap 30. In a manner as described with respect to FIG. 1, flow shaping cone 50 is retained by nozzle nut 40 screwedly engaged with nozzle cap 30.

FIG. 2 also shows shroud 81 which may be situated around the nozzle generally and extend to the surface to be cut. Not shown is a suitable vacuum system in communication with the interior of the volume defined by shroud 81 for removing cuttings and for collecting fluid. Such a shroud is particularly useful in applications such as cutting concrete.

Figure 3:
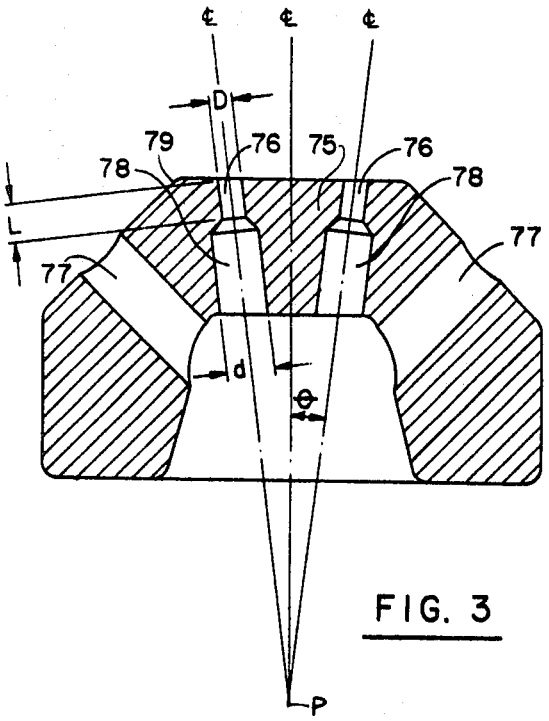
FIGS. 3 and 4 are cross-sectional views showing different embodiments of orifice cones of this invention.
Figure 8:
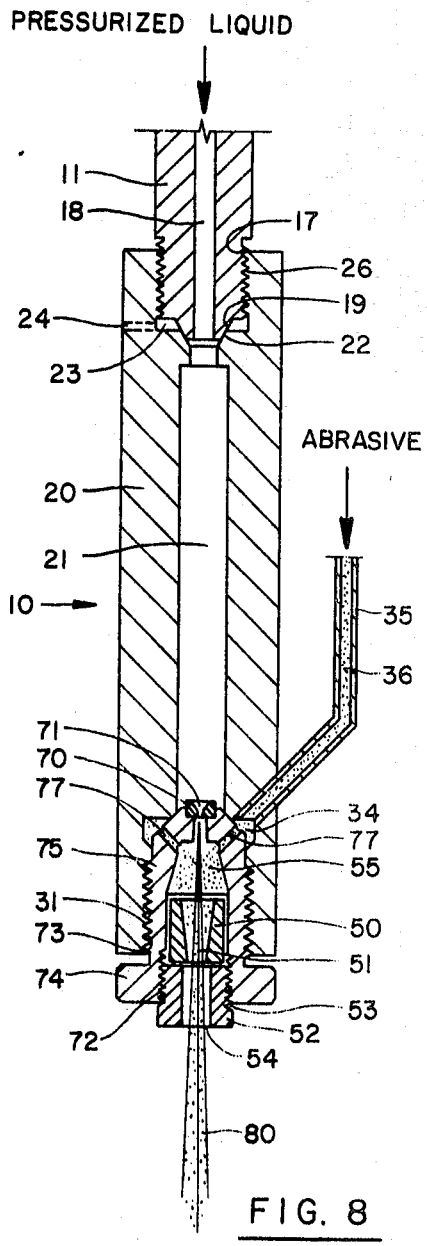
FIG. 8 is a cross-sectional view showing another embodiment of a particulate-fluid jet nozzle according to this invention.

FIG. 3 is an enlarged cross-sectional view of one embodiment of an orifice cone suitable for use in this invention. In this embodiment, multiple fluid orifices 76 and fluid orifice outlets 78 are drilled directly through the top of cone 75. Two or more converging fluid orifices may be used. Abrasive orifices 77 are drilled directly through the orifice cone tapered walls. Tapered side walls 79 are suitably tapered in the portion between abrasive orifices 77 and fluid orifices 76 to seat tightly against the tapered bottom of nozzle body 20. The inlet to abrasive orifices 77 is in communication with abrasive chamber 34 which is supplied abrasive by abrasive chamber 87 as shown in FIG. 2 or directly by abrasive feed means 35 as shown in FIG. 8. The center lines of the individual fluid orifices 76 converge at a point P which is on the center line of the orifice cone. The angle of the converging fluid orifices 76 with the center line of orifice cone 75 is suitably about 3° to about 10°. Fluid orifices 76 are shaped such that the length of the flow restriction, L, is about 1 to about 4 times the diameter of the restricted portion, D. The lower portion of the fluid orifice has an enlarged portion 78 having a diameter, d, sufficiently large so as to not interfere with the fluid jet formed in the fluid jet portion 76.

Figure 4:
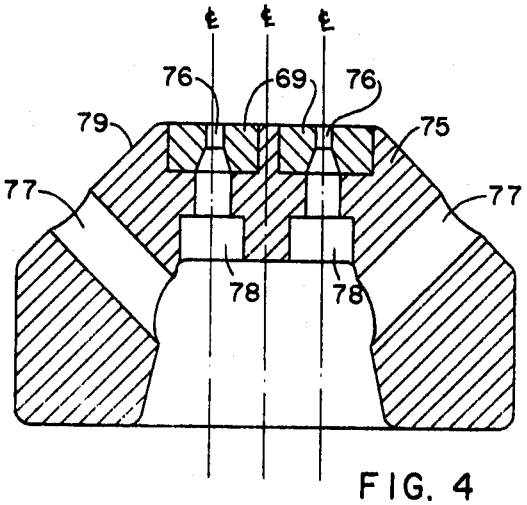

FIG. 4 shows another embodiment of an orifice cone according to this invention wherein the center lines of multiple fluid orifices 76 are parallel to the center line of orifice cone 75. As shown in FIG. 4, separate orifice plates 69 may be mounted in recesses in the top of orifice cone 75 providing replacement of orifice plates and easier fabrication by avoidance of precision drilling of the orifice cone. The orifice cones useful in this invention may be drilled directly to provide fluid orifices 76 or may have separate orifice plates set in retaining receptacles in orifice cones. The orifice cone 75 may have abrasive orifices directly drilled through the side of the orifice cone, as shown in FIG. 4, or have the abrasive orifices drilled through the nozzle cap 30, as shown in FIG. 1.

Figure 5:
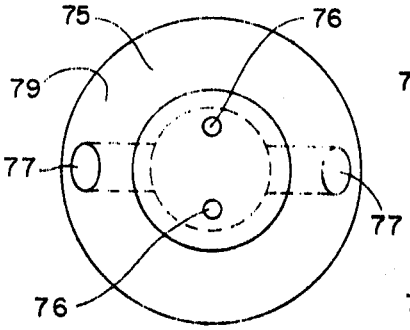
FIGS. 5, 6 and 7 are top views of different embodiments of orifice cones.
Figure 6:
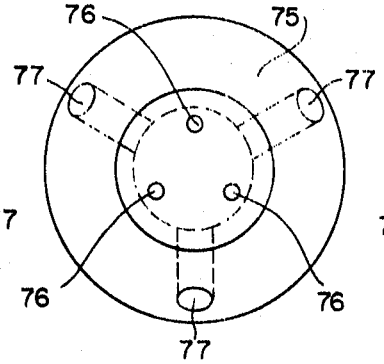
Figure 7:
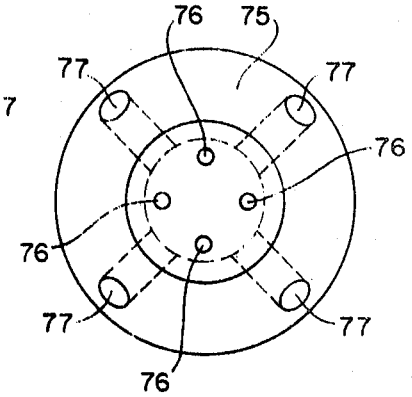

FIGS. 5 through 7 show top views of various embodiments of orifice cones useful in this invention. Particularly suitable orifice cones are those having two or more fluid orifices and two or more abrasive orifices for better mixing of the abrasive particulates with the fluid jet. Any number and combination of orifices for enhancing the desired mixing may be used, dictated primarily by the diameter of orifices and the orifice cone at the top, preferably from 2 to 8 and particulary preferred are 3 to 6 orifices positioned in a circular pattern with equal angular spacing and with the same number of orifices for each fluid and particulates. FIGS. 5 through 7 show specific configurations suitable for 2, 3 and 4 orifice cones according to preferred embodiments of this invention. As shown in FIGS. 5–7, one particularly advantageous arrangement of multiple fluid and particulate jets is to space the particulate jets on an arc midway between the fluid jets. Such an arrangement enhances the mixing of solids with the fluid jets. The orifice cones are preferably made of hardened stainless steel, tungsten carbide, boron carbide, hard ceramics, sintered ceramics such as high purity aluminum oxide, and the orifice plates 69 are preferably made of ruby, sapphire, hard ceramics, or other hard orifice materials having the desired dimensions and orifice geometry.

The multiple converging fluid jets created by the orifice cone shown in FIG. 3 and the parallel fluid jets created by the orifice cone shown in FIG. 4 create a central volume of the fluid jets of reduced pressure into which the abrasive particles can be mixed by the natural powerful suction produced by the fluid motion. Because of the dispersion of the fluid jets, the parallel fluid jets will be in contact with one another or will converge into a single jet downstream from the fluid orifices. The flow shaping cone 50 in the nozzle assembly allows some control on the convergence of the multiple parallel fluid jets. The multiple fluid jets generate suction which may be used to transport the particulate solids or solids containing foam into the solids chamber 34 from a distant reservoir and is useful to mix the solids into the liquid jets. The converging fluid jets, as shown in FIG. 3, can advantageously be used to form different shaped jets, such as a fan-shaped abrasive fluid jet, for cutting wide grooves and for removing materials from a large surface area. Another means for forming multiple fluid jets is to provide a single orifice plate as shown in FIG. 1 with multiple orifices. In each case, a suitable flow shaping cone must be used with the particular orifice or combination of orifices to obtain the best results.

FIG. 9 shows another embodiment of a nozzle and orifice cone according to this invention wherein orifice support cone 60 is held tightly against nozzle body 20 by nozzle cap 30 in a tapered fit such that the tapered end of nozzle body 20 is inside the tapered concavity defined by walls 62 of support cone 60. Having the tapered end of nozzle body 20 inside support cone 60 is advantageous in obtaining a seal with minimum torque of nozzle cap 30 and with nozzle body 20 having minimum wall thickness, as the fluid pressure inside fluid chamber 21 assists sealing by expanding the tapered end of nozzle body 20 against tapered walls 62. Orifice support cone 60 is snugly fit inside a recess of nozzle cap 30. The tapered, concave orifice cone nozzle body arrangement can be advantageously applied in generating fluid jets, with or without particulates, under a wide range of fluid pressures. By adjusting the taper angle and the thickness of tapered end of the nozzle body, positive seal can be obtained due to the fluid pressure. Orifice support cone 60 shown in FIG. 9 has multiple orifice plates 70 mounted in the recesses in the top of orifice support cone 60 for generating multiple parallel jets that eventually merge into a single jet stream after exiting from the opening of flow-shaping cone 50. Also shown in FIG. 9 is abrasive flow shaping ring 134 within mixing chamber 55 to direct the particulates toward the center portion of mixing chamber 55 to avoid jamming the passage through flow-shaping cone 50. Flow-shaping ring 134 may be made of any suitable wear resistant material, such as ultra-high-molecular-weight polyolefins.

Generally, the prior art devices utilize a long conical nozzle or Venturi to force the particulates, water and air together into one jet stream. Although hard materials such as tungsten carbide, boron carbide and ceramics have been used to construct such nozzles, they have worn out quickly. The prior art nozzles have been rigidly attached to the nozzle body by threaded or bolted arrangement making concentricity of fluid streams critical. Lack of concern in prior art devices of the relative size of fluid streams and nozzle openings and on the position of this nozzle and its throat length have further reduced the effectiveness of the prior nozzles in generating suction and in entraining abrasives. It is not uncommon in current sandblasting practices that a nozzle made of very hard boron carbide wears out quickly as the abrasive-bearing fluid stream actually impinges on the nozzle itself. The use of oversized or undersized nozzles in current sandblasting practices is a common occurrence. The present invention, on the other hand, gives attention to this portion of the nozzle, which is termed a flow-shaping cone. According to this invention, the flow-shaping cone is preferably loosely fitted inside a holder and is thus capable of aligning itself with the fluid jets. The flow-shaping cone is made of selected materials according to the jet configurations and intended applications. The flow-shaping cone used in this invention is made of hard and abrasion-resistant materials. The preferred materials for heavy duty applications are tungsten carbide, silicon carbide, boron carbide and sintered ceramics. For light duty applications, the flow-shaping cone can be made from cross linked polyolefins, ultra-high-molecular-weight polyeolfins, and fiber filled polyurethanes. The flow-shaping cone has a conical interior tapered to a short throat and may have a flared exit. The inside diameter of the throat, as well as the interior dimensions of the cone, are in proper relationship with the size of the envelope of the water jet or bundle of water jets, which is related to the jet configuration and jet dispersion. In sizing the throat opening of the flow-shaping cone, it is desirable that the cone just touches the edge of the fluid jet such that fluid droplets are deflected toward the core of the fluid jets and the fluid jets are slightly deformed to form an envelope around the circular throat. Such arrangement can also keep the escape of unentrained abrasive particles to a minimum and generate very strong suction at the center of the bundle of circularly positioned fluid jets. Ideally, all the abrasive particles should be entrained into the fluid jets at the center of the bundle of fluid jets so that maximum particle entrainment and minimum wear of flow-shaping cone can be achieved. The jet configuration and dispersion are determined by the characteristics and configuration of orifices, fluid pressure and characteristic of the fluid. The longitudinal position of the flow-shaping cone in relationship to the fluid jet is purposely made adjustable in this invention. Thus, the position of the throat can be strategically placed such that it will not interfere with the fluid jets while limiting the escape of abrasives around the fluid jet to a minimum. By sizing the length and the inside diameter of the throat of the flowshaping cone as described and by positioning the cone according to jet dispersion, a very strong suction can be generated by the fluid jets. Such suction action can effectively entrain solid particles into the fluid jet and accelerate them to high speed.

Another embodiment of a suitable high velocity particulate containing fluid jet apparatus of this invention is shown in FIG. 8 wherein orifice cone 75 is shown with external threads 73 for engaging orifice cone 75 directly with the lower portion of nozzle body 20. In this embodiment, suitable fluid jets are provided by orifice plate 70 with orifice 71 and solid particulates supplied by solids feed means 35 are supplied to solids chamber 34 for feeding through solids orifices 77 into mixing chamber 55. The orifice cone 75 can also have multiple orifice plates 70 to generate multiple jets. Flow-shaping cone 50 is loosely retained within the bottom portion of orifice cone 75 by being threadedly engaged with flow shaping cone support nut 52 having through passage 54. The lower portion of orifice cone 75 has orifice cone flange 74 for readily tightening orifice cone 75 into nozzle body 20. Flow shaping cone support plug allows flow shaping cone 50 to be raised or lowered by turning of support plug 52. Likewise, the upper portion of nozzle body 20 threadedly receives pressurized fluid inlet tube 11 with inlet tube through passage 18 for supply of fluid to pressurized fluid chamber 21.

Figure 13:
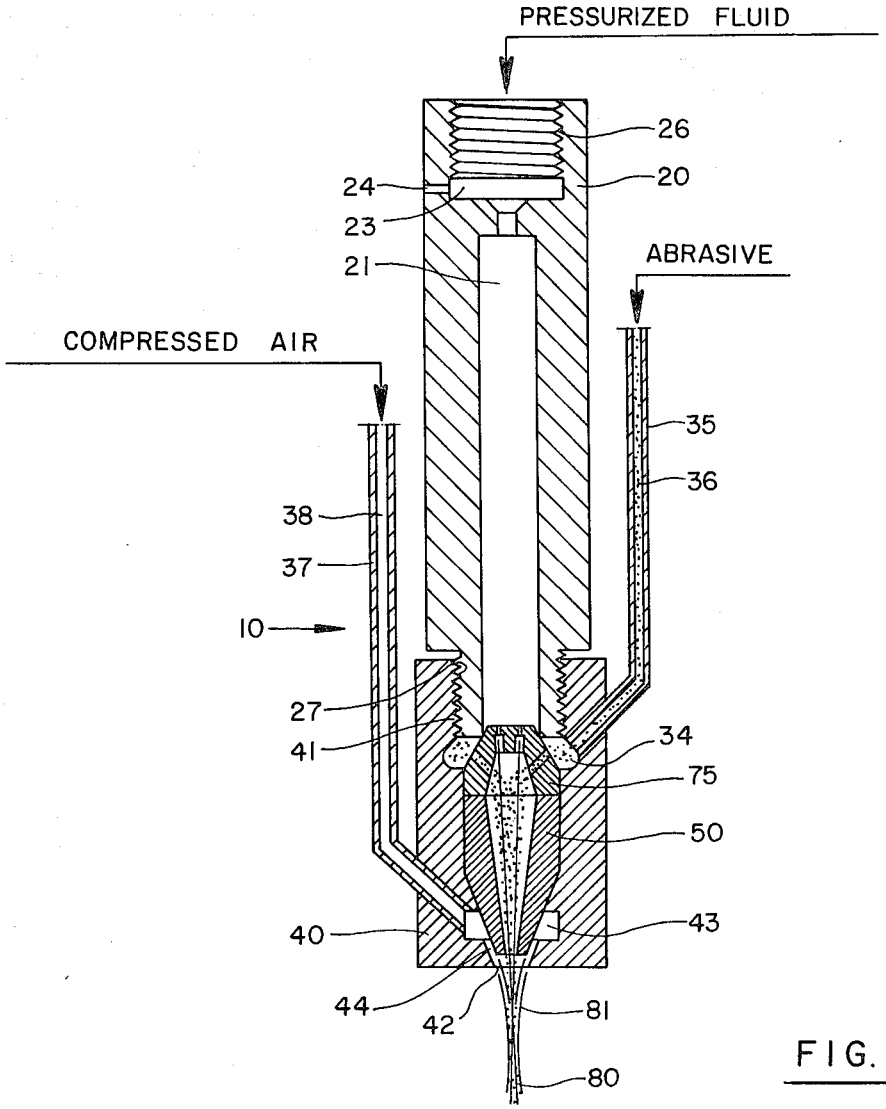
FIG. 13 is a cross-sectional view showing another embodiment of a nozzle suitable for the particulate-fluid jet according to this invention utilizing compressed air to form a shroud around the particulate-fluid jet.

FIG. 13 shows another embodiment of a nozzle according to this invention wherein nozzle nut 40 is threadedly engaged with the lower portion of nozzle body 20 and retains orifice cone 75 and flow shaping cone 50 within a cavity of nozzle nut 40. The embodiment shown in FIG. 13 additionally has compressed air feed means 37 with passage 38 providing compressed air to air chamber 43 within nozzle nut 40 arranged, together with the external shape of flow shaping cone 50 and nozzle nut through passage 42, to provide annular air passage 44 forming air shroud 81 around particulate containing fluid jet 80. This embodiment is particularly useful when an abrasive fluid jet is used under submerged conditions to isolate the abrasive water jet at the nozzle exit from surrounding water, thus minimizing interfering effect of the surrounding water. The air shroud can be formed in different shapes to accommodate the particulate fluid jet of different geometries, for example, an air shrouded abrasive water jet can be in the shape of a flat sheet which may be effectively used in removing marine growth from underwater structures. The nozzle of this invention permits the application of abrasive entrained water jet under water without significant reduction of effectiveness due to the air shroud. The use of wet abrasive foam according to this invention further enhances the advantage of this invention in submerged applications.

FIGS. 10–12 illustrate another embodiment of this invention and show an abrasive fluid jet apparatus for drilling or deep kerfing applications. In the embodiment shown in FIG. 10, the fluid jet is formed in the same fashion as generally described with respect to FIG. 8, the axis of the abrasive fluid jet being at an angle to nozzle body 130 which is a drill head having carbide tip 131. By rotation of drill head 130, a hole can be drilled into rock, concrete, or other hard materials such that the hole will be larger than the nozzle assembly. In FIG. 10, rotating jet nozzle 120 is shown with fluid tube 123, annular abrasive channels 122 and having outer cover 121. This is best seen in FIGS. 11A and 11B which are cross sections shown by line 11—11 in FIG. 9. In the embodiment shown in FIG. 11B, abrasive channels 122 are provided by the slotted interior surface of outer tube 121 while fluid tube 123 is smooth and round. This embodiment is particularly advantageous in drilling applications as outer tube 121 can be the torque transmitting drill tube. When high torqure is not necessary, outer tube 121 can be an extruded plastic tube having the slotted fluid tube 123 to provide passage for abrasives as shown in FIG. 11A. Using extruded plastic tubing for outer tube 121 is much more economical than using slotted metal tube shown in FIG. 11B. The abrasive particulates flow through abrasive inlets 126 into mixing chamber 127, mix with the fluid jet through flow shaping cone 128 retained by retainer screw 129 and the abrasive fluid jet passes through oblique jet opening 132 in drill head 130. Slots can be produced by moving drill head 130 in a straight line in addition to its rotation. If rotating jet nozzle 120 is allowed to enter into a hole or slot in a continuous operation, deep holes or slots can be obtained, the depth being limited by the length of the nozzle tube. Tungsten, carbide or other cutting materials may be utilized as tip 131 or cutters 133 to aid in the drilling and cutting. The rotating jet nozzle in accordance with this invention may also have multiple abrasive fluid jets in drill head 130 for use in drilling larger holes or slots.

Figure 14:
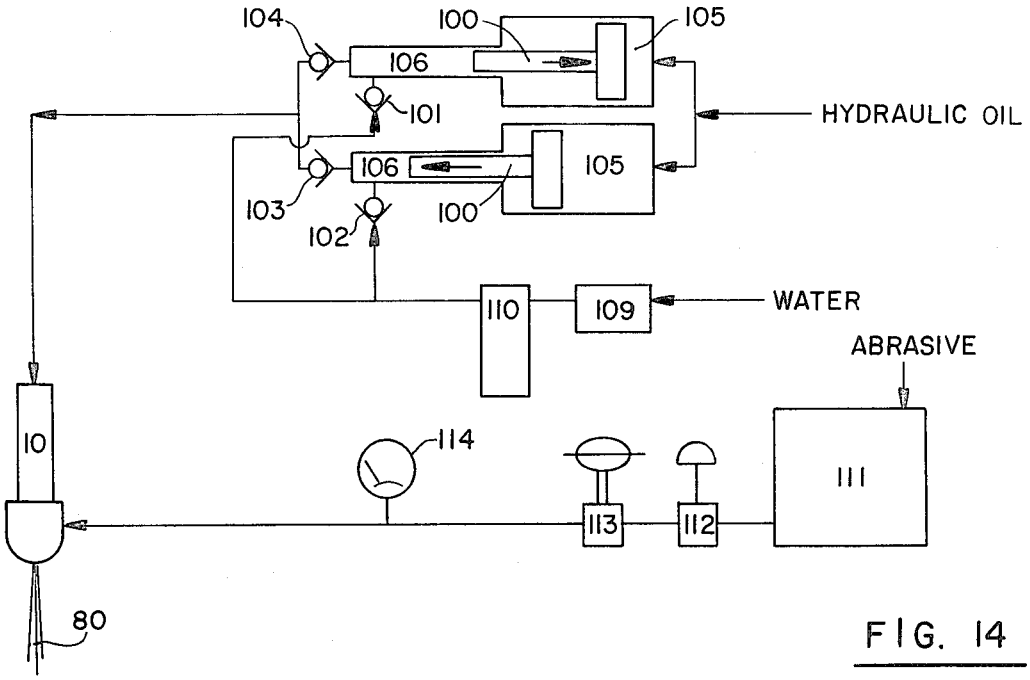
FIG. 14 is a diagrammatic showing of the principal components of a system using this invention.

FIG. 14 illustrates schematically the components of a system for use of the apparatus of this invention. Fluid pressure intensifier means to generate suitable fluid pressure for the specific use for which the system is designed may be used. For lower fluid pressures a number of suitable devices are known to the art. For higher pressures, dual fluid pressure intensifiers driven by hydraulic oil are suitable. Also suitable for high pressures are triplex positive-displacement piston pumps driven by a prime mover, such as an engine or an electric motor connected to the pump through a speed reducing means. A preferred embodiment is shown in FIG. 14 wherein dual fluid pressure intensifiers 100 are driven by a pressurized hydraulic oil or fluid passing into hydraulic cylinder 105. Water or other fluid to be pressurized for the fluid jet is provided from a supply means by pump 109 through filter 110 and check valves 101 and 102 to fluid cylinders 106 for pressurization. The pressurized fluid passes from fluid cylinders 106 through check valves 103 and 104 to mixing nozzle 10. Solid particulates, such as abrasives, may be stored in slurry or foam form in solids tank 111 and their passage to the fluid-solid mixing nozzle 10 controlled by solids valve 112. In one embodiment solids are stored in foam form in solids tank 111 and passage to fluid-solid mixing nozzle 10 is controlled by valve 112 and pressure regulator 113 with pressure gauge 114. In a preferred embodiment, the hydraulic fluid is supplied by a conventional hydraulic power source to dual pressure intensifiers which are operated in opposing synchronism to avoid pressure fluctuations at the output and eliminate the need for a high pressure accumulator. By use of such pressure intensifiers liquid can be obtained at pressure levels as high as 60,000 psi. Abrasive water jets with suitable abrasive foams according to this invention formed using up to 60,000 psi water are able to perform desired cutting of hard metals, rock and concrete. Many applications of the abrasive water jet of this invention will not require water jets of these pressures, but will require liquid pressures in the order of 10,000 to 30,000 psi which may be obtained from direct driven plunger or piston pumps which are commercially available. Use of the abrasive water jet formed in accordance with this invention and using the nozzles of this invention, steel plate and other hard materials can be cut with utilization of fluid pressures of less than 30,000 psi and in many applications, a fluid pressure of less than 15,000 psi. Suitable control means for the system as schematically set forth in FIG. 14 are not shown, but are readily apparent to one skilled in the art to involve electrical and electromechanical valves and timing devices as necessary.

From the above description, it is readily seen that the disclosed method of forming high velocity particulate containing fluid jets by introducing the solid particulates contained in a foam into the fluid jet stream is particularly advantageous for a wide number of abrasive fluid jet processes. The apparatus and process of this invention lends itself to closely controlling the flow rate of solid particulates to the nozzle, especially in cases where the solids are conveniently transported over a relatively long distance. The particulate containing foam can be readily released under pressure or pumped through a hose or tubing over a long distance without settlement and with minimum wear and abrasion problems. When the foam makes contact with the fluid jet, it presents little interference to the fluid jet as the foam is largely gaseous bubbles. The efficiency of transferring solid particulates to the fluid jet by utilization of the foam containing the particles is very high as the particles have been previously wetted and dispersed. The quantity of the solids introduced into the fluid jet and the properties of the particulate containing foam can be readily changed to meet special needs by adjustment of the foam formulation. The apparatus and process of this invention provides an abrasive fluid jet which has cutting capabilities heretofore unobtainable and provides such capabilities with no dust being emitted with the abrasive stream. Fluid jet pressures of up to 150,000 psi may be used with nozzles of this invention and the flow rate and pattern can be easily changed by changing the nozzles. Abrasives may be chosen from a wide range of available types and grades according to hardness of the materials to be cut and the formed abrasive fluid jet can be applied to a wide variety of cutting operations, including underwater applications.

While immediate application of the process and apparatus of this invention has been described with respect to cutting materials, such as plastics, composites, glass, ceramics, metals, concrete and rock, it is readily apparent that the process and apparatus of this invention is advantageously applicable to all streams containing a mixture of solid particulates in a fluid stream. While the fluid streams have been described as liquid streams, such as water, it is readily apparent that fluid streams such as air other gaseous fluids may be readily used. The most advantageous distance from the fluid-solid mixing nozzle to the material desired to be cut or cleaned can be readily ascertained by one using the method and apparatus of this invention.

The following examples setting forth specific materials, quantities, sizes, and the like are for the purpose of more fully understanding very specific embodiments of the invention and are not meant to limit the invention in any way.

EXAMPLE I

This example shows one preferred process for formulating an abrasive foam for use in this invention. Twenty-five grams of sodium bentonite powder were added slowly into 300 ml of tap water with stirring until all the sodium bentonite particles were uniformly suspended in water to form a colloid. This mixture was allowed to stand for 24 hours fully hydrating sodium bentonite to form a gel. This gel was thixotropic in nature providing a gel structure which breaks down readily when shearing or stirring so that the gel became fluid and pumpable with gelling occurring again shortly after the sodium bentonite slurry was allowed to stand undisturbed. The apparent viscosity of the gel and the viscosity of the colloid upon stirring were function of the amount of sodium bentonite added, too much sodium bentonite rendering the colloid too heavy for pumping.

Four hundred (400) grams of aluminum oxide powder having the grid number of 220 (average particle size—50 microns) were slowly added to the sodium bentonite colloid under agitation until all the abrasive powder were evenly distributed throughout a slurry. The apparent viscosity of this mixture was quite high even under stirring. If agitation was stopped and the mixture was allowed to stand undisturbed, some of the aluminum oxide grains would settle to the bottom. The settled aluminum oxide particles can pack into hard cake, making it very difficult to suspend the settled particles again.

Lanthanol LAL-70, sodium lauryl sulfoacetate, supplied as 70 percent active reagent in powder form and marketed by Stepan Chemical Company, was added as a foaming agent to the water-sodium bentonite-aluminum oxide slurry shortly after the addition of aluminum oxide powder. This foaming agent was added to the abrasive slurry in solution form made by dissolving 3.5 grams of the foaming agent powder in 100 ml tap water. A total of 50 ml of foaming agent solution were added to the abrasive slurry with agitation. Numerous small air bubbles immediately formed in the slurry and the apparent viscosity of the resulting foamed abrasive slurry was significantly reduced as a result of the foaming action.

The foamed abrasive slurry exhibited characteristics that are particularly advantageous to the process of this invention. The viscosity of the foamed abrasive slurry under agitation was significantly less than the abrasive slurry before the addition of the foaming agent. However, when the foamed abrasive slurry was undisturbed, the slurry would still settle into a gel without losing the air bubbles such that the heavy aluminum oxide particles, specific gravity 3.9, will not settle to the bottom of the container even after prolonged storage. Once agitated, the foamed abrasive slurry became easily pumpable and was fluid enough to flow through plastic tubing of ⅛ inch inside diameter under low pressure with no visible separation of the abrasive particles occurred in the tubing. When the foamed abrasive slurry contacted a small stream of water, the foam bubbles broke down readily and the abrasive particles washed away with the water stream.

EXAMPLE II

A nozzle having the basic design as shown in FIG. 1, was constructed having the cylindrical nozzle body made of hardened stainless steel of the type commonly used for constructing pressure vessels and fittings. The nozzle body has an external diameter of 1.0 inch and 4.5 inches long. The internal bore of the nozzle body is 0.25 inch, which extends from the lower end of the nozzle body for 3.5 inches and then narrowed to 3/16 inch hole at the upper end and ends in an enlarged internal threaded cavity which accommodates a ¾ inch gland nut and a ⅜ inch diameter high pressure tube in an arrangement typically used in high pressure connections. The upper end of the 3/16 inch bore hole has a tapered edge to mate with the tapered lower end of the high pressure tube. A tube collar is used as shown in FIG. 1. The opposite end of the nozzle body has external threads of 0.75 inch in length to fit internal threads of a nozzle cap, and a tapered bore edge at the lower to fit a support cone, as shown in FIG. 1. The nozzle cap is made of hardened stainless steel in the form of a short, hollow cylinder, having internal threads on both end cavities which are joined by a central passage of 0.20 inch in diameter. The threaded cavities are 0.75 inch in diameter and depth and the total length of the nozzle cap is 1.75 inches. One end of the nozzle cap is mated with the externally threaded end of the nozzle body and a support cone while the other end is mated with a nozzle nut. A slanted 1/16 inch diameter hole through the nozzle cap places the solids mixing cavity in communication with the solids feed means by a 3/16 inch diameter stainless steel tube for introducing abrasive foam into the nozzle. A support cone with upper tapered exterior walls of about 45° to fit the nozzle body tapered bore is made of stainless steel. The external diameter of the support cone is 0.200 inch at the top, 0.490 inch at the middle, and 0.180 inch at the bottom. The top of the support cone has a circular recess to accommodate a circular orifice plate. A tapered central passage extends through the support cone from top to bottom having a diameter of 0.06 inch at the top and 0.150 inch at the bottom.

An orifice plate is made of sapphire in the form of a circular disk of 0.088 inch in diameter and 0.052 inch in thickness. A single cone-shaped orifice is situated at the center of this disk. This orifice has a 80° taper at top and a straight orifice at bottom, with the internal surface of the cone-shaped orifice being very smooth. The diameter of the orifice is about 0.060 inch at top and 0.020 inch at bottom and the length of the straight section of the orifice about 0.030 inch. Silicone adhesive is used to mount the orifice plate into the recess of the support cone and to provide a seal. A flow shaping cone is made of sintered ceramics for hardness and abrasion resistance and is a cylindrical cone 0.500 inch long with an outside diameter of 0.490 inch. The flow shaping cone has a tapered internal through passage of 0.200 inch diameter at top and 0.060 inch diameter at bottom. This cone fits loosely in the cavity of the nozzle nut, which is stainless steel and screws into the nozzle cap. The nozzle nut can be rotated to adjust the distance of the flow shaping cone to the orifice plate so the exit of the flow shaping cone is slightly larger than the fluid jet.

The described nozzle assembly is capable of withstanding fluid pressure up to 60,000 psi at room temperature and mixing fluid with abrasive foam as prepared in Example I. An abrasive containing water jet was generated downstream from the orifice and was substantially coherent over a distance of several inches. By moving the nozzle nut up and down, it is possible to situate the flow shaping cone such that the exit opening of the flow shaping cone is only slightly larger than the diameter of the water jet at the location. Because of the loose fit, the flow shaping cone will align itself to the water jet so as to minimize the wear of the cone exit. By so doing, little or no abrasive foam flows out around the water jet so that the consumption of the abrasive foam can be kept at a minimum. Such abrasive containing water jets were found to be capable of cutting steel and concrete using abrasive concentrations of 1 to 3 pounds per minute in the water jets.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A nozzle apparatus for producing a fluid jet stream comprising solid particulates, said apparatus comprising: a central pressurized fluid chamber capable of withstanding a pressure between about 10,000 to about 60,000 psi; pressurized fluid supply means capable of supplying fluid at a pressure between about 10,000 to about 60,000 psi and fluid inlet means to one end of said pressurized fluid chamber; fluid orifice means having a plurality of outlets forming at the other end of said chamber pressurized multiple fluid streams symmetrical to a central axis and the central portion of said multiple fluid streams having a volume of reduced pressure; solids particulate supply means and solids inlet means comprising multiple orifices positioned at an angle to said central axis and peripheral to said fluid orifice means providing said solids passing through said solids inlet means movement at an angle to and in the direction of and mixing with said multiple fluid streams forming said fluid jet; and a flow shaping nozzle having a tapered converging through passage shaped and positioned for said fluid jet stream comprising solid particulates to pass through the throat of said flow shaping nozzle, said throat being substantially at the periphery of said fluid jet stream comprising solid particulates.

2. The nozzle apparatus of claim 1 wherein said fluid orifice means comprises 2 to 8 orifices.

3. The nozzle apparatus of claim 2 wherein each said fluid orifice is a separate orifice plate having a centrally located hole and said orifice plates are mounted on an orifice support cone.

4. The nozzle apparatus of claim 2 wherein said fluid orifices are substantially parallel.

5. The nozzle apparatus of claims 1 or 2 wherein said flow shaping nozzle is axially movable along the axis of said fluid jet stream.

6. The nozzle apparatus of claims 1 or 2 or 4 wherein said solids multiple orifices comprise 2 to 8 orifices.

7. The nozzle apparatus of claims 1 or 2 or 3 wherein said fluid orifice means is within an orifice cone, said orifice cone having a tapered portion for mating with a tapered portion at said other end of said fluid chamber.

8. A system for producing a fluid jet stream comprising solid particulates comprising:

a nozzle apparatus comprising a central pressurized fluid chamber capable of withstanding a pressure between about 10,000 to about 60,000 psi; fluid inlet means in one end of said fluid chamber; fluid orifice means having a plurality of outlets forming at the other end of said chamber pressurized multiple fluid streams symmetrical to a central axis and the central portion of said multiple fluid streams having a volume of reduced pressure; solids inlet means comprising multiple orifices positioned at an angle to said central axis and peripheral to said fluid orifice means providing said solids passing through said solids inlet means movement at an angle to and in the direction of and mixing with said multiple fluid streams forming said fluid jet; and a flow shaping nozzle having a tapered converging through passage shaped and positioned for said fluid jet stream comprising solid particulates to pass through the throat of said flow shaping nozzle, said throat being substantially at the periphery of said fluid jet stream comprising solid particulates;

fluid pressure intensifier means capable of supplying fluid at a pressure between about 10,000 to about 60,000 psi in communication with said fluid inlet means; and solid particulates slurry mixing tank in communication with a foam forming means, said foam forming means in communication with said solids inlet means.

9. The system for producing a fluid jet stream of claim 8 wherein said fluid pressure intensifier means comprises dual fluid pressure intensifiers driven by hydraulic oil.

10. The system for producing a fluid jet stream of claim 8 wherein said fluid pressure intensifier means comprises a triplex positive displacement piston pump driven by a prime mover coupled to said pump through speed reducing means.

11. The system for producing a fluid jet stream of claim 8 wherein said fluid orifice means is within an orifice cone, said orifice cone having a tapered portion for mating with a tapered portion at said other end of said fluid chamber.

12. The system for producing a fluid jet stream of claim 8 wherein said fluid orifice means comprises 2 to 8 orifices.

13. The system for producing a fluid jet stream of claim 12 wherein each said fluid orifice is a separate orifice plate having a centrally located hole and said orifice plates are mounted on an orifice support cone.

14. The system for producing a fluid jet stream of claim 12 wherein said fluid orifices are substantially parallel.

15. The system for producing a fluid jet stream of claim 8 wherein said flow shaping nozzle is axially movable along the axis of said fluid jet stream.

16. A nozzle apparatus for producing a fluid jet stream comprising solid particulates, said apparatus comprising: a central pressurized fluid chamber; pressurized fluid supply means and fluid inlet means to one end of said fluid chamber; fluid orifice means capable of forming at least one fluid stream at the other end of said chamber; solids particulate supply means and solids inlet means comprising multiple orifices positioned at an angle to the axis of and peripheral to said fluid orifice means providing said solids passing through said solids inlet means mix with said fluid jet; and a flow shaping nozzle having a tapered converging through passage shaped and positioned for said fluid jet stream comprising solid particulates to pass through the throat of said flow shaping nozzle, said throat being substantially at the periphery of said fluid jet stream comprising solids particulates, said flow shaping nozzle being laterally movable with respect to the axis of said fluid jet stream and self-aligning therewith.

17. The nozzle apparatus of claim 16 wherein said fluid orifice means comprises 2 to 8 orifices.

18. The nozzle apparatus of claim 17 wherein each said fluid orifice is a separate orifice plate having a centrally located hole and said orifice plates are mounted on an orifice support cone.

19. The nozzle apparatus of claim 17 wherein said fluid orifices are substantially parallel.

20. The nozzle apparatus of claim 16 wherein said flow shaping nozzle is axially movable along the axis of said fluid jet stream.

21. The nozzle apparatus of claim 16 wherein said solids multiple orifices comprise 2 to 8 orifices.

22. The nozzle apparatus of claim 16 wherein said fluid orifice means is within an orifice cone, said orifice cone having a tapered portion for mating with a tapered portion at said other end of said fluid chamber.

23. A system for producing a fluid jet stream comprising solid particulates comprising:

a nozzle apparatus comprising a central pressurized fluid chamber; fluid inlet means in one end of said fluid chamber; fluid orifice means capable of forming at the other end of said chamber multiple fluid streams symmetrical to a central axis; solids inlet means comprising multiple orifices positioned at an angle to said central axis and peripheral to said fluid orifice means providing said solids passing through said solids inlet means movement at an angle to and in the direction of and mixing with said multiple fluid streams forming said fluid jet; and a flow shaping nozzle having a tapered converging through passage shaped and positioned for said fluid jet stream comprising solid particulates to pass through the throat of said flow shaping nozzle, said throat being substantially at the periphery of said fluid jet stream comprising solid particulates, said flow shaping nozzle being laterally movable with respect to the axis of said fluid jet stream and self-aligning therewith;

fluid pressure intensifier means in communication with said fluid inlet means; and solid particulates slurry mixing tank in communication with a foam forming means, said foam forming means in communication with said solids inlet means.

* * * * *